US006343446B1

(12) United States Patent
Beard

(10) Patent No.: US 6,343,446 B1
(45) Date of Patent: Feb. 5, 2002

(54) POST ANCHOR SYSTEM

(75) Inventor: Ty Beard, Bartlett, IL (US)

(73) Assignee: Unistrut International Corporation, Wayne, MI (US)

( * ) Notice: Subject to any disclaimer, the term of this patent is extended or adjusted under 35 U.S.C. 154(b) by 0 days.

(21) Appl. No.: 09/626,406

(22) Filed: Jul. 26, 2000

Related U.S. Application Data

(60) Provisional application No. 60/145,769, filed on Jul. 27, 1999.

(51) Int. Cl.[7] ..... E02D 5/74

(52) U.S. Cl. ..... 52/165; 52/98; 189/29; 248/545; D25/131

(58) Field of Search ..... 52/153, 156, 155, 52/709

(56) References Cited

U.S. PATENT DOCUMENTS 3,066,769 A * 12/1962 Pasquale ..... 189/29
4,553,358 A * 11/1985 Deike ..... 52/98
4,615,156 A * 10/1986 Deike ..... 52/98
5,082,231 A * 1/1992 Knowles ..... 248/545
D424,713 S * 5/2000 Blackwell ..... D25/131

* cited by examiner

*Primary Examiner*—Carl D. Friedman
*Assistant Examiner*—Steve Varner
(74) *Attorney, Agent, or Firm*—Banner & Witcoff, Ltd.

(57) ABSTRACT

There is disclosed a sign post anchor system that provides omni-directional stabilization of a sign post. The inventive anchor system includes a tubular anchor sleeve having a square cross-section for receiving at one end the sign post and at the other end the tubular post anchor. The anchor sleeve includes a plurality of spaced apart holes located along the longitudinal axis of the sleeve for permitting selective mounting of the sign post. The anchor sleeve further includes a plurality of fins secured to the corners of the anchor sleeve and extending outward from the sleeve. The plurality of fins provide stabilization of the anchor sleeve and accompanying sign post.

7 Claims, 6 Drawing Sheets

POST ANCHOR SYSTEM

SPECIFICATION

This application claims the benefit of priority of U.S. Provisional Application 60/145,769 filed Jul. 27, 1999.

BACKGROUND OF THE INVENTION

1. Field of Invention

The present invention relates in general to post anchors. More specifically, but without restriction to the particular use which is shown and described, this invention relates to post support anchors that incorporate fin members which are secured to the periphery of the anchor to provide omni-directional stabilizing of the anchor and accompanying post.

2. Description of the Related Art

Fence and sign post support anchors are well recognized and well known in the art. As conventional, the sign post anchor is a tubular device that is driven into the ground to receive the sign post and mount the sign post in an upright position. Fastening means are often used to attach the sign post to the in-ground post anchor to secure the sign post in the upright position. Also conventional are post anchors which include height adjustment means to set the sign post at a desired height above the ground. Examples of conventional post anchors can be found in Deike, U.S. Pat. Nos. 4,615,156 and 4,320,608 and Jewett et al., U.S. Pat. No. 5,749,180. Many known post anchor systems, however, are prone to tilting and/or rotation due to wind loading or other types of impact on the sign post. Other known problems with existing post anchors include poor drivability into the ground. Accordingly, there is a need for an improved post anchor for anchoring sign posts in the ground that provides better stabilization of the sign post and improved drivability into the ground. The present invention provides a solution to these and other known problems common to conventional post anchors.

SUMMARY OF THE INVENTION

Accordingly, it is an object of the present invention to provide a post anchor system that prevents rotation and/or tilting of the sign post. It is another object to provide a post anchor system that provides for incremental adjustment of the height of the sign post. Still another object of the present invention is to provide a means for improved stabilization of the sign post that also permits ease of drivability of the post anchor into the ground.

Briefly, in summary, the present invention provides a sign post anchor system comprising a tubular anchor sleeve having a square cross-section for receiving at one end the sign post and, at the other end, the post anchor. The anchor sleeve of the present invention defines four sides and four corners, and a plurality of spaced apart holes located along the longitudinal axis of the sleeve for permitting selective adjustment and mounting of the sign post. The sign post anchor system of the present invention further comprises a plurality of fins secured to the corners of the anchor sleeve and extending outward from the sleeve. The plurality of fins provide omni-directional stabilization of the anchor sleeve and accompanying sign post, after installation into the ground. That is, the fins prevent rotation and/or tilting of the sign post when the sign post is exposed to wind forces or other external loading conditions on the sign post. The fins include a tapered contour to further provide enhanced drivability of the post anchor into the ground. Alternatively, the present invention may define a one-piece anchor system that incorporates the plurality of fins at the corners of the anchor to provide the omni-directional stabilization of the sign post.

The full range of objects, aspects and advantages of the invention are only appreciated by a fill reading of this specification and a full understanding of the invention. Therefore, to complete this specification, a detailed description of the invention and the preferred embodiments follow, after a brief description of the drawings.

BRIEF DESCRIPTION OF THE DRAWINGS

The preferred embodiments of the invention will be described in relation to the accompanying drawings. In the drawings, the following figures have the following general nature.

DESCRIPTION OF THE PREFERRED EMBODIMENTS

Figure 3:
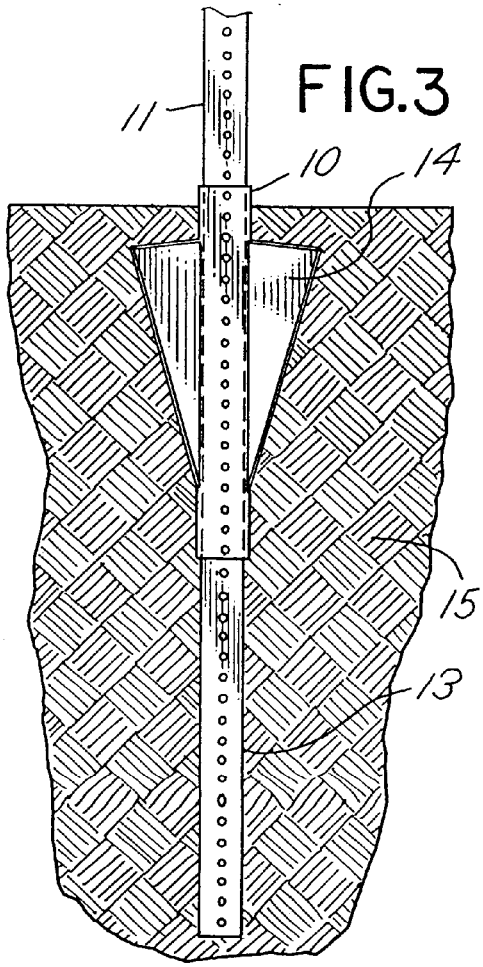
FIG. 3 is a side elevation view of the two-piece assembly of the post anchor sleeve of FIG. 1.

Referring to the figures wherein like numerals indicate like elements, there is shown in FIGS. 1–6 a preferred embodiment of the present invention which provides omni-directional stabilization of a sign post. As exemplified by the figures, the preferred embodiment includes a post anchor sleeve 10 which receives at its upper end a sign post 11, or similar object, to mount the post or object in an upright position. Received within its lower end is an anchor post 13. As depicted in FIG. 3, the anchor sleeve 10 and anchor post 13 are embedded into the ground 15. The post anchor sleeve 10 is illustrated as a tubular member having a square cross-section for receiving a similar shaped sign post and anchor post 13. The sleeve 10 is preferably Telespar® tubing manufactured by Unistrut Corporation and may be made from steel having a galvanized or plain finish. It should be understood to those skilled in the art that other types and shapes of tubing, including tubing having a round cross-section, may be used with the present invention. As preferred, the sleeve 10 includes a plurality of holes 12 located in longitudinal alignment along the length of the sleeve and on all four sides of the sleeve. The holes 12 are preferably 7/16 inches in diameter and are spaced one inch apart on all four sides. Through the use of fasteners, not shown, the spaced apart holes 12 permit the mounting of and selective incremental adjustment of the sign post 11 to the anchor sleeve 10. The holes 12 further permit the incremental adjustment of the sleeve 10 relative to the embedded anchor post 13. For a more detailed discussion of the benefits and features of this adjustable tubing, U.S. Pat. No. 5,188,479, issued to Nehls, and assigned to Unistrut International Corporation is incorporated herein by reference.

The subject matter of the invention relates specifically to the mechanism for providing omni-directional stabilizing of the sign post and anchor after they are installed in the ground. In the embodiments of the invention depicted, attached to the sleeve 10 at its corners are stabilizing fins or plates 14 which provide enhanced stabilization of the post anchor system. The fins 14 are attached to the periphery of the sleeve 10 at its corners 16. As preferred, the fins are welded to the corners 16 and extend outward and away from the corners. It should be understood that other means for attaching the fins to the sleeve corners may be used with the present invention. It should be further understood that the fins may be positioned at locations other than the corners and that any number of fins may be used depending on the desired application. The fins 14 are preferably 4 inch×12 inch×10 gauge steel plate which, as stated, are welded to all four corners of the tubing, preferably Telespar® tubing. As attached, the fins advantageously provide the anchor with omni-directional stabilizing, thereby preventing rotation and tilting of the installed sign post.

Figure 1:
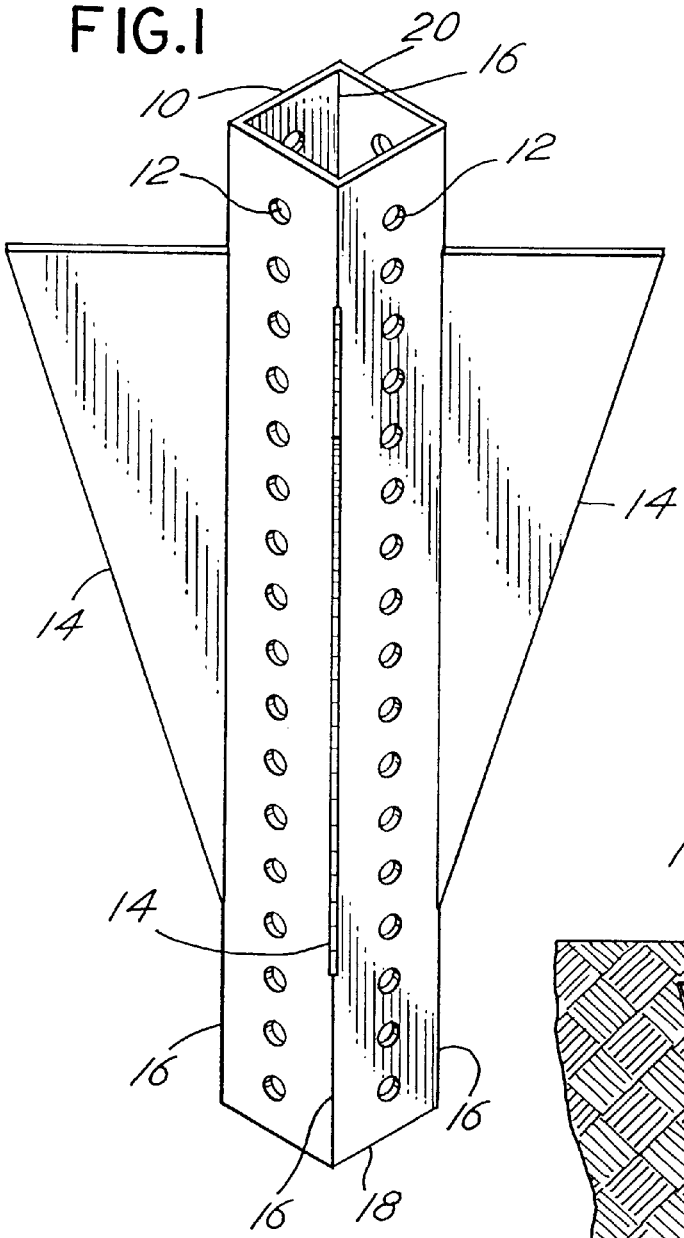
FIG. 1 is an isometric view of the post anchor sleeve of the invention.

In addition to the omni-directional stabilization, the fins enhance the drivability of the sleeve 10 into the ground. In the embodiments, the fins provide a taper or slope which improves the drivability of the sleeve 10. As shown in FIG. 1, the fin has a taper extending the entire length of the fin. That is, near the distal end 18 of the sleeve 10, the fin forms into the corner 16 of the sleeve. Beginning approximately 3 and ½ inches from the distal end 18, the fin tapers outward and away from the sleeve body. At its furthermost extension, which is near the proximal end 20, the fin extends outward approximately 4 inches from the corner 16 of the sleeve 10.

Figure 2:
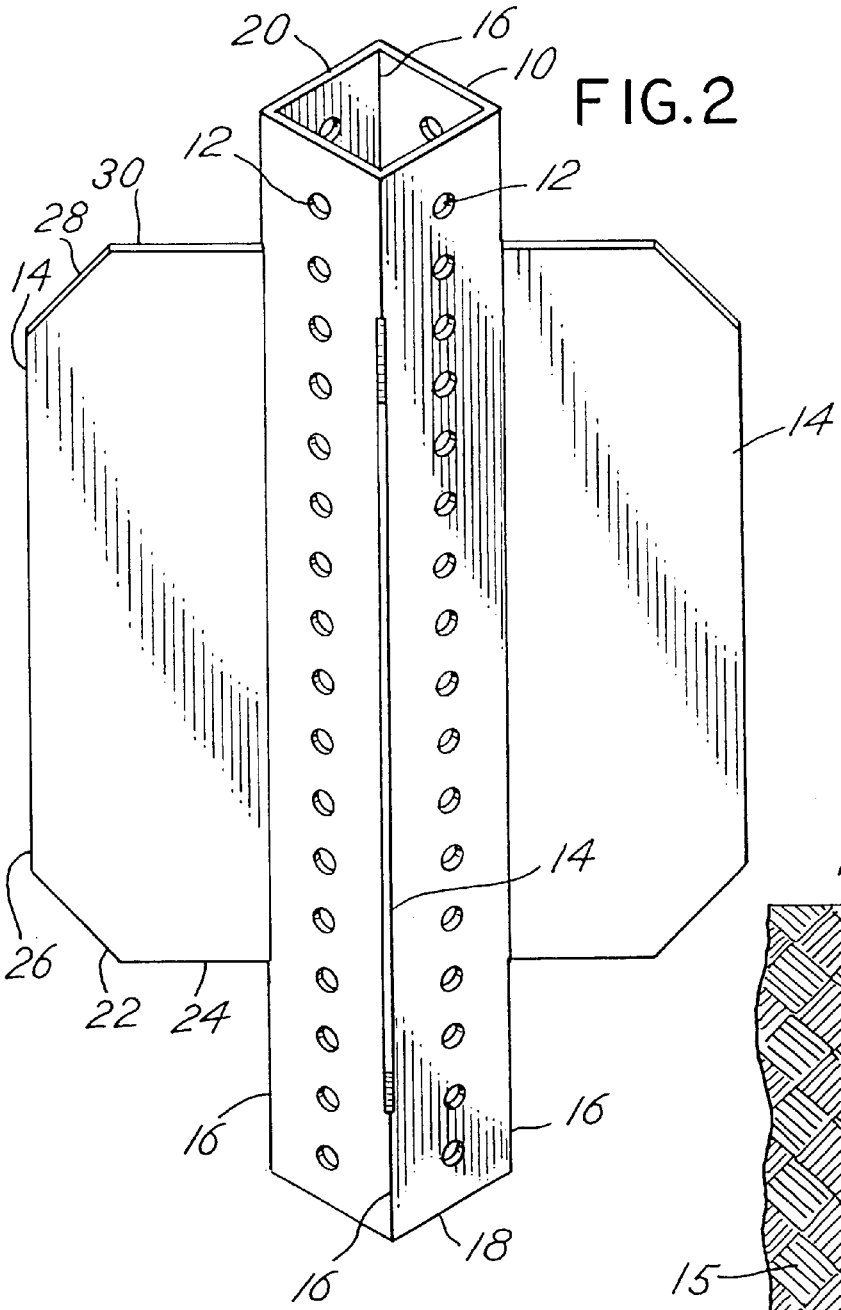
FIG. 2 is an isometric view of an alternative embodiment of the post anchor sleeve of the invention.
Figure 4:
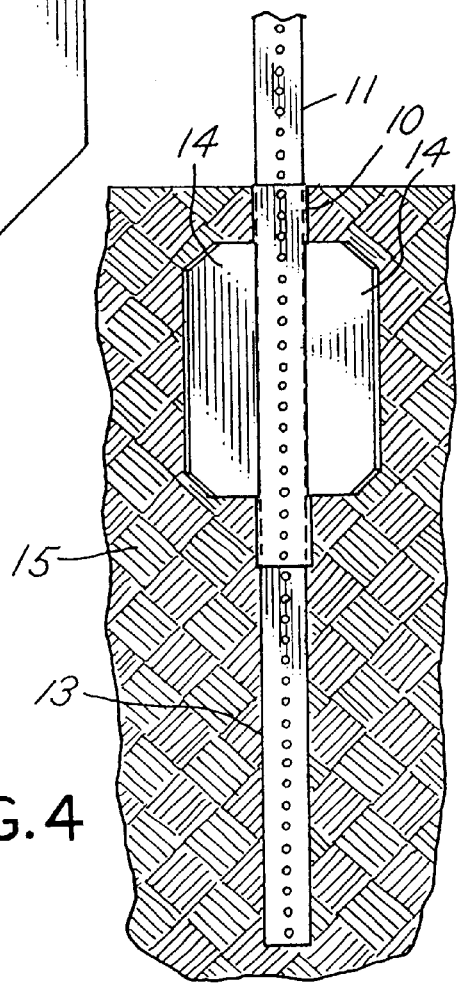
FIG. 4 is a side elevation view of the two-piece assembly of the post anchor sleeve of FIG. 2.
Figure 5:
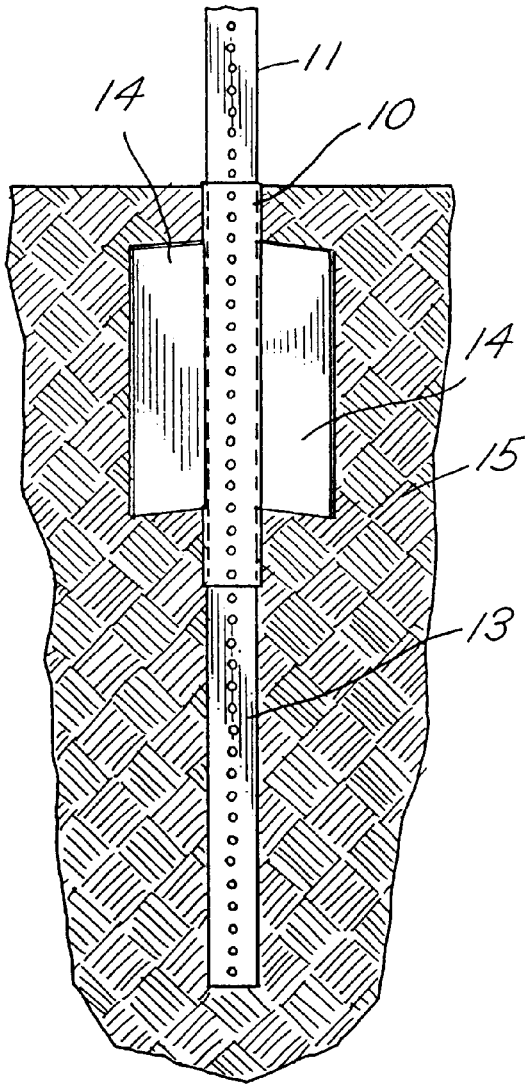
FIG. 5 is a side elevation view of the two-piece assembly of an alternative embodiment of the post anchor sleeve of FIG. 1.
Figure 6:
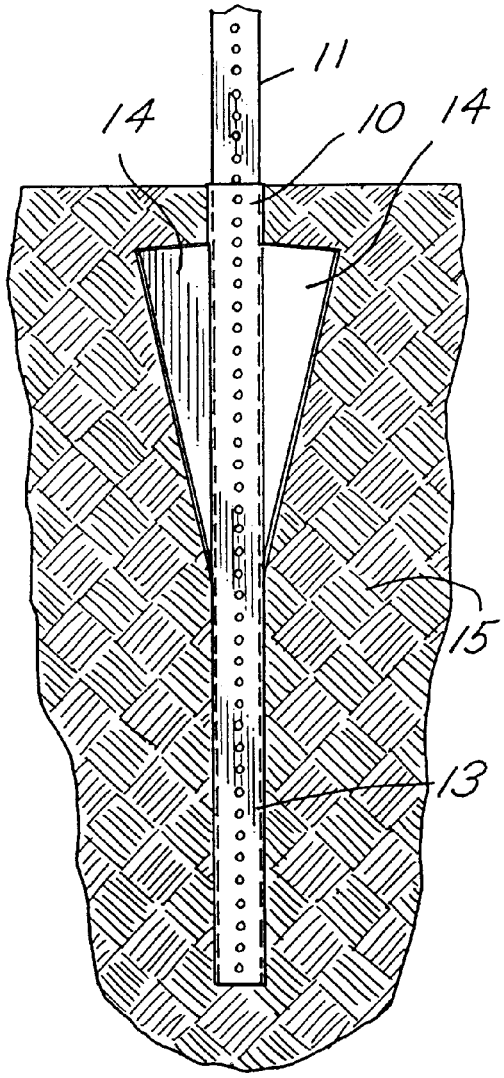
FIG. 6 is a side elevation view of the two-piece assembly of an alternative embodiment of the post anchor sleeve of FIG. 1.
Figure 7:
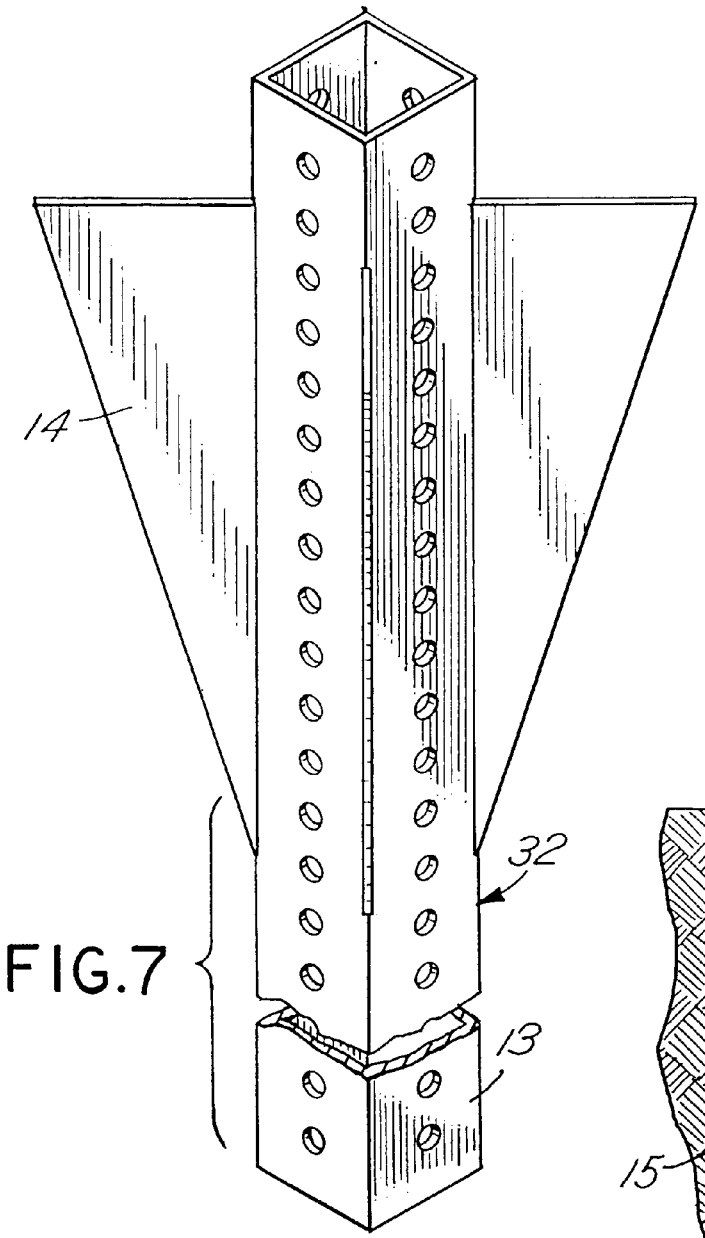
FIG. 7 is an isometric view of the post anchor of the invention.
Figure 8:
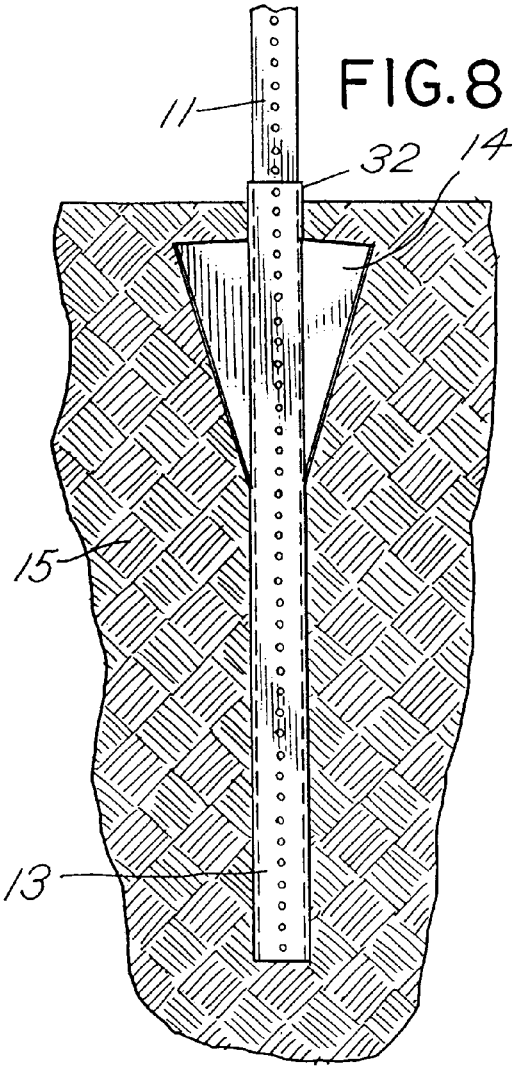
FIG. 8 is a side elevation view of the post anchor of FIG. 7.
Figure 9:
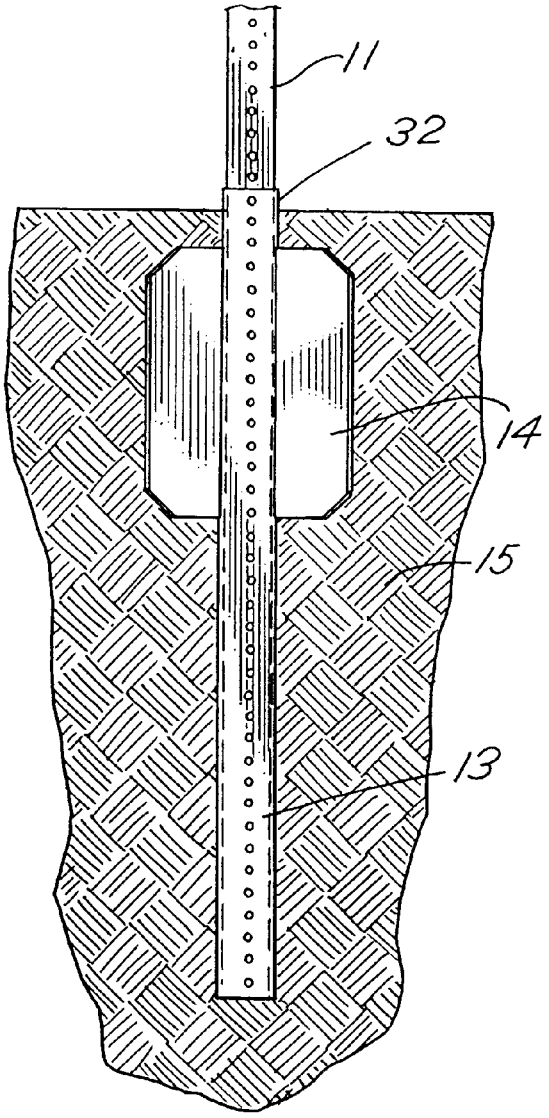
FIG. 9 is a side elevation view of an alternative embodiment of the post anchor of FIG. 7.
Figure 10:
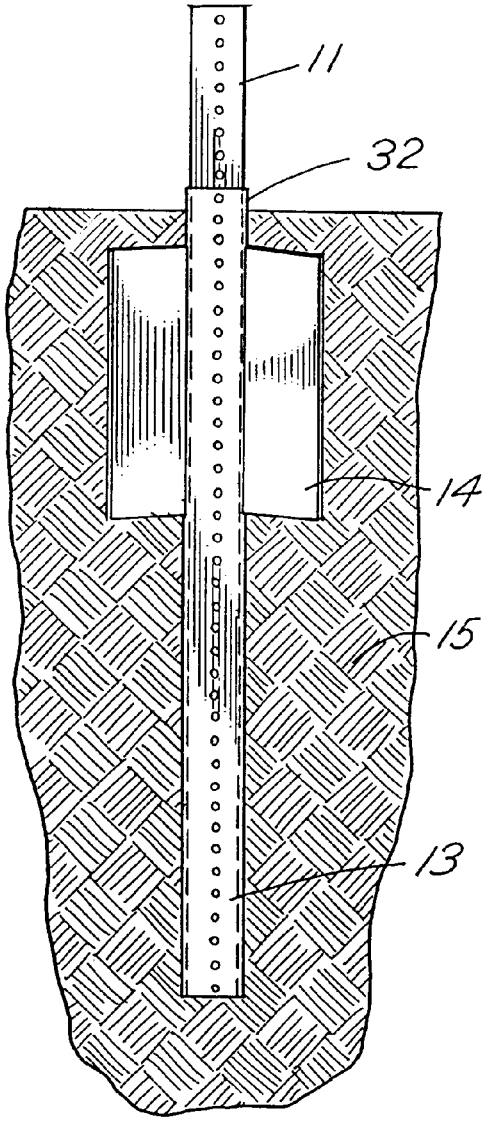
FIG. 10 is a side elevation view of an alternative embodiment of the post anchor of FIG. 7.
Figure 11:
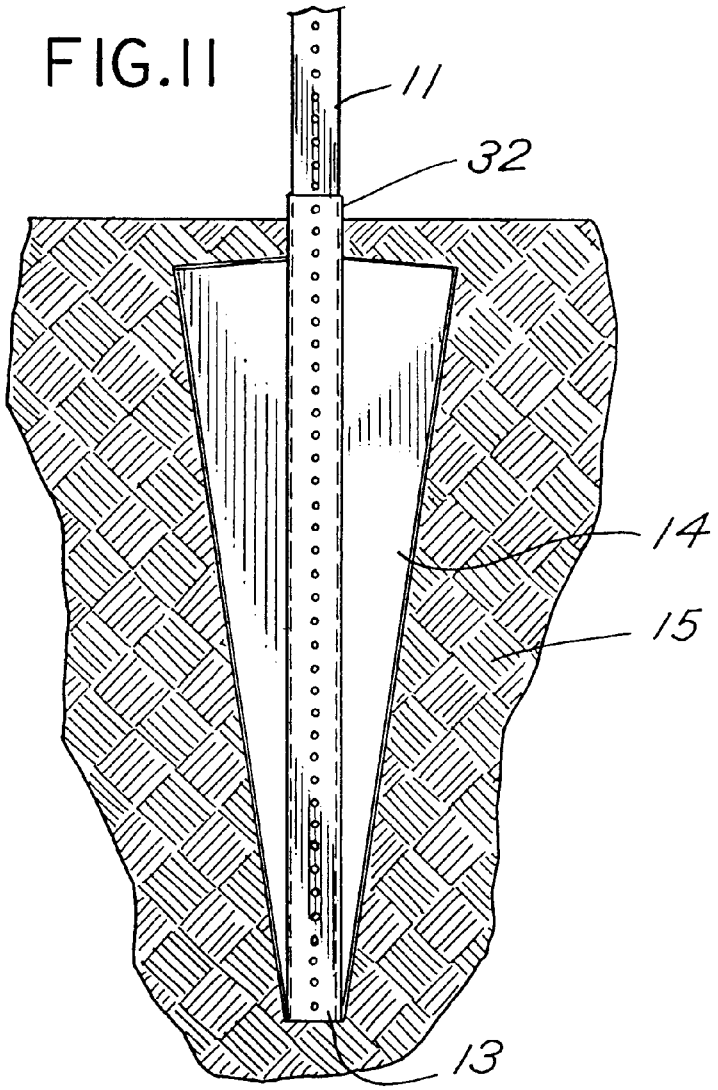
FIG. 11 is a side elevation view of an alternative embodiment of the post anchor of FIG. 7.
Figure 12:
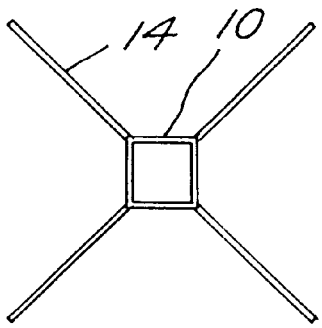
FIG. 12 is an end view of the post anchor sleeve of FIG. 1.
Figure 13:
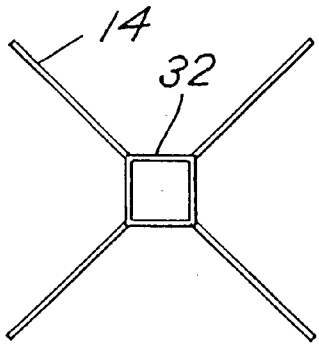
FIG. 13 is an end view of the post anchor of FIG. 7.

Alternative forms of the fin may be used with the present invention some of which are illustrated in FIGS. 2–6. As an example, shown in FIG. 2 is a fin 14 having a small taper 22 which begins at the end 24 of the fin and terminates along the side 26 of the fin. The fin in FIG. 2 also provides a second small taper 28 which begins along the side 26 of the fin and terminates at the end 30. Each of the fins of the embodiment of FIG. 2 incorporates these tapers. This fin also extends outward from the sleeve 10 approximately 4 inches and is attached to the sleeve approximately 3 and ½ inches from the distal end 18. Other variations of the fin 14 are depicted in FIGS. 5 and 6.

The overall size and length of the sleeve anchor 10 may vary depending on the application. As most preferred, the sleeve anchor may be made from 12 gauge steel tubing having square dimensions ranging from 1 inch up to 2 and ½ inches; 14 gauge tubing having square dimensions ranging from 1 and ¾ inches up to 2 and ¼ inches; 10 gauge tubing having square dimensions ranging from 2 inches up to 2 and ½ inches; or 8 or 7 gauge steel tubing having a square dimension of 3 inches. As preferred, the overall length of the sleeve anchor may vary from 12 inches to 60 inches for all sizes of tubing. It should be obvious to one skilled in the art that variations to these dimensions are possible without being outside the spirit and scope of the present invention.

Alternatively, and as depicted in FIGS. 7–11, the present invention may be incorporated as a single stabilizing anchor 32 whereby the sleeve 10 and anchor post 13 comprise a single unit. As above, the fins 14 are preferably attached to the periphery of the anchor at its corners. The fins in FIGS. 7–11 are the same in all respects to the fins illustrated in FIGS. 1–6, previously described. Also, as previously discussed, the overall size and length of the one piece anchor is the same as the two piece anchor sleeve and anchor post.

The preferred embodiments of the invention are now described as to enable a person of ordinary skill in the art to make and use the same. Variations of the preferred embodiments are possible without being outside the scope of the present invention. As an example, for sign posts that do not utilize adjustable sleeve anchors, the fins of the present invention may be welded directly to the sign posts to prevent rotation and tilting of the posts. Therefore, to particularly point out and distinctly claim the subject matter regarded as the invention, the following claims conclude the specification.

What is claimed is:

1. A sign post anchor system for use with sign posts comprising:

a tubular anchor sleeve having a square cross-section for receiving at one end the sign post, the anchor sleeve receiving at an opposing end a post anchor, the anchor sleeve defining a longitudinal axis, four sides and four corners, the anchor sleeve having a plurality of spaced apart holes located along the longitudinal axis of at least one of the four sides of the sleeve for selective mounting of the sign post and the post anchor; and a plurality of fins attached to the corners of the anchor sleeve and extending outward from the sleeve, whereby the fins provide omni-directional stabilization of the anchor sleeve and sign post.

2. The sign post anchor system of claim 1 wherein the plurality of fins are four fins attached to the four corners of the sleeve.

3. The sign post anchor system of claim 1 wherein the plurality of fins define a taper for enhanced installation of the sleeve into the ground.

4. The sign post anchor system of claim 1 wherein the plurality of fins are made from ten gauge galvanized steel plate.

5. A sign post anchor system for use with sign posts comprising:

a tubular anchor sleeve having a non-circular cross-section for receiving at one end the sign post, the anchor sleeve receiving at an opposing end a post anchor, the anchor sleeve defining a longitudinal axis, a plurality of sides and corners, the anchor sleeve including a plurality of spaced apart holes located along the longitudinal axis of at least one of the sides of the sleeve for selective mounting of the sign post and the post anchor; and at least one fin attached to the corner of the anchor sleeve and extending outward from the sleeve, whereby the at least one fin provides stabilization of the sign post.

6. The sign post anchor system of claim 5 wherein the at least one fin defines a taper for enhanced installation into the ground.

7. The sign post anchor system of claim 5 wherein the at least one fin defines a pair of opposing tapered portions.

* * * * *